United States Patent [19]

Knowles

[11] 4,213,411

[45] Jul. 22, 1980

[54] READILY ATTACHABLE AND DETACHABLE SOLE PLATE FOR A SEWING MACHINE

[75] Inventor: Warren D. Knowles, Clark, N.J.

[73] Assignee: The Singer Company, Stamford, Conn.

[21] Appl. No.: 62,213

[22] Filed: Jul. 30, 1979

[51] Int. Cl.[3] ..... D05B 29/12

[52] U.S. Cl. ..... 112/240

[58] Field of Search ..... 112/240, 261, 235, 60, 112/61

[56] References Cited

U.S. PATENT DOCUMENTS

| | | | |
|---|---|---|---|
| 2,317,185 | 4/1943 | Dunlap et al. | 112/261 |
| 3,489,114 | 1/1970 | Seck | 112/240 |

FOREIGN PATENT DOCUMENTS

| | | | |
|---|---|---|---|
| 4865446 | 11/1971 | Japan . | |
| 5077037 | 11/1973 | Japan . | |
| 5285647 | 12/1975 | Japan . | |
| 225248 | 10/1964 | Sweden . | |
| 591591 | 9/1977 | Switzerland | 112/235 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A sewing machine presser device is provided with a sole plate and with a latching spring which can be snapped into a retaining notch at the rear edge of a shank on the device and easily removed therefrom with only slight pressure applied to the toe end portion of the plate.

6 Claims, 6 Drawing Figures

READILY ATTACHABLE AND DETACHABLE SOLE PLATE FOR A SEWING MACHINE

BACKGROUND OF THE INVENTION

1. Field of the Invention

The invention relates to sewing machine presser devices. More particularly, the invention is directed to a presser device permitting the quick and easy attachment and removal of sole plates.

2. Description of the Prior Art

The prior art includes many presser devices intended to provide for quick exchangeability of presser foot sole plates on sewing machines. However, the prior art devices have generally been deficient either because they were so constructed as to require an excessive number of parts and were costly to produce; or because the sole plates were not easily removed or replaced. A novel design for a presser device aimed at overcoming such deficiencies is disclosed in my copending patent application, Ser. No. 020,672 for "Snap-On Presser Foot Plate" filed Mar. 15, 1979, (Pat. No. 4,183,311) and assigned to the Singer Company. The present invention provides a further improved presser device permitting a sole plate to be quickly and easily removed or attached to a shank of the device with only slight pressure applied to the toe end portion of the plate.

SUMMARY OF THE INVENTION

A presser device, in accordance with the invention, includes a shank with a notch in the rear edge and a sole plate with a toe end portion, a heel end portion, a work engaging portion therebetween, and a hinge pin mounted on the work engaging portion. The device also includes a latching spring for attaching the sole plate to the shank. Such spring includes spaced apart side portions, a cross piece interconnecting the side portions, and aligned fingers which are substantially parallel to the cross piece and are pivotally connected to the sole plate. The side portions of the spring include a bend which forms knees at positions providing for their engagement by the heel end portion of the sole plate and enabling the cross piece of the spring upon the application of pressure to the knees of the spring by said heel end portion to be urged against the rear edge of the shank and snapped into the notch in the shank edge while the hinge pin is in the recess in the bottom of the shank of the presser device. The sole plate is detached from the shank with the application of downward and rearward pressure to the toe end of the sole plate effective to pivot the sole plate on the knees of the spring such that a pivot pin on the sole plate is moved out of a slot in a notch in the bottom of the shank, and effective to then cause the cross piece of the latching spring to be extricated from the notch in the rear edge of the shank.

Figure 1:
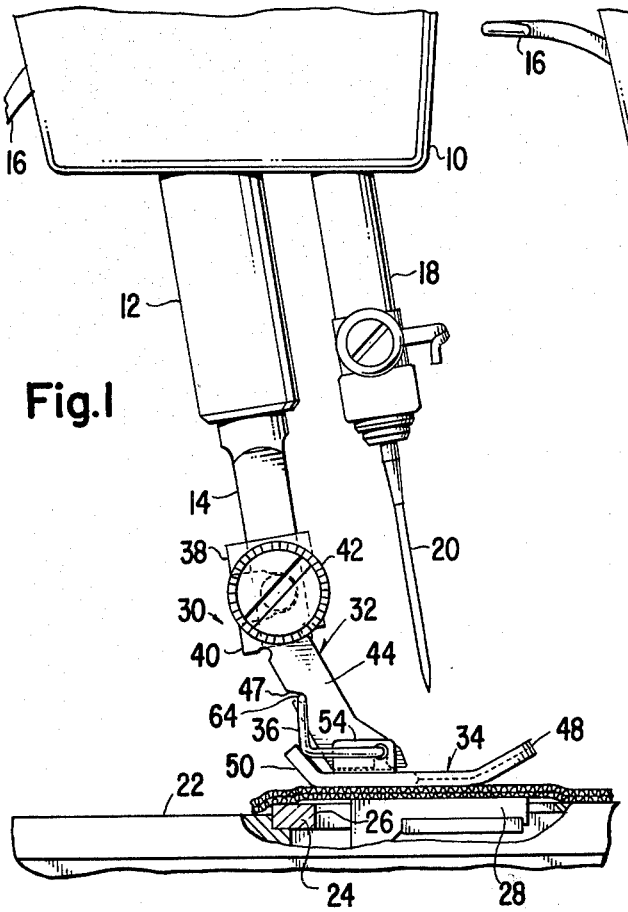
FIG. 1 is a side elevational view of a fragment of a sewing machine showing the presser device of the invention on a lowered presser bar.
Figure 2:
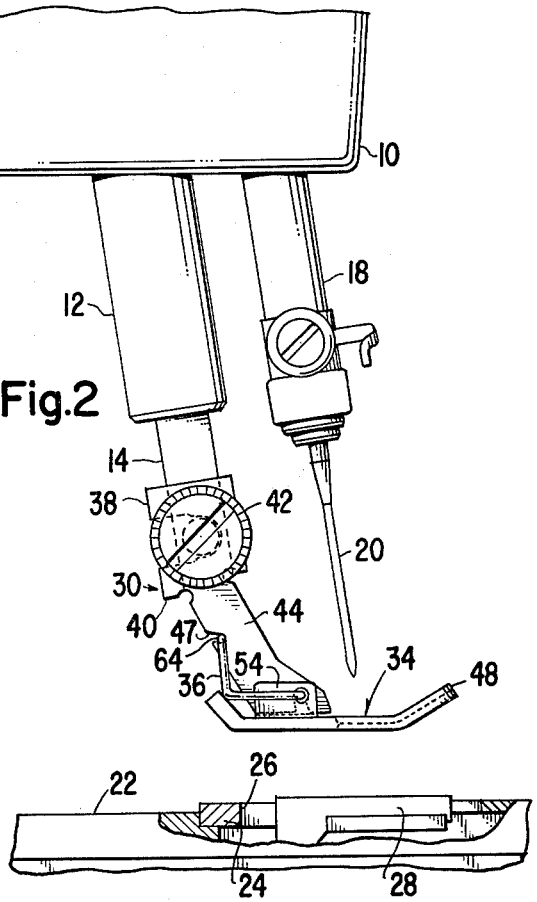
FIG. 2 is a view similar to FIG. 1, but with the presser bar in a released position.
Figure 3:
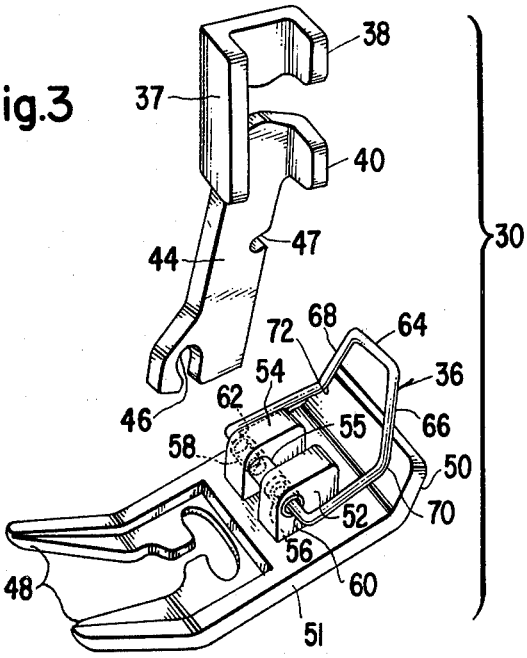
FIG. 3 is an enlarged perspective view of the presser device of the invention.
Figure 4:
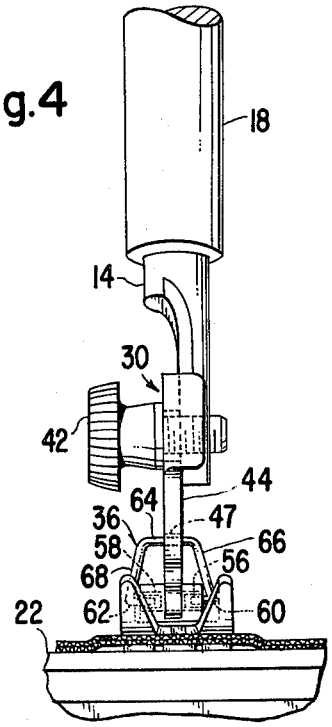
FIG. 4 is a front elevational view of a portion of the sewing machine fragment of FIG. 1 including the presser device of the invention.

Referring to the drawings, reference character 10 designates the bracket arm of a sewing machine frame. A bushing 12 is secured in the bracket arm and a presser bar 14 is slidable endwise in the bushing. The presser bar, as is conventional, is provided with a spring (not shown) to bias it downwardly, however, the presser bar may be raised and lowered at will by a presser lifting lever 16 carried in the bracket arm. A needle bar 18 carrying a needle 20 for the formation of stitches is endwise reciprocable in the bracket arm. The sewing machine frame includes a work supporting bed 22 beneath the bracket arm. The bed carries a throat plate 24 that is formed with slots 26 through which a plastic feed dog 28 of a conventional sewing machine work feed mechanism is operative. Carried on the presser bar above the feed dog is the presser device 30 of the invention. Such presser device 30 includes a shank, a sole plate, and a latching spring, each of which have been generally indicated by a reference character, namely the reference characters 32, 34 and 36 respectively.

The presser foot shank 32 which is preferably fabricated of a sheet metal stamping is formed at the top with a U-shaped presser bar accommodating seat defined at one side by an outturned tab 37 and at the other side by outturned bifurcations 38 and 40. The presser foot shank is secured to the presser bar by means of a shouldered clamp screw 42 which passes between the bifurcations and is threaded into the presser bar 14. Depending from the presser bar accommodating seat is a blade 44 in the bottom of which there is a slot 46 and in the rear edge of which there is a notch 47 that extends forwardly and downwardly.

The sole plate 34 includes toe end portions 48, heel end portion 50, and a working portion 51 therebetween with upstanding ears 52 and 54 spaced apart a distance substantially equal to the thickness of blade 44 on the presser foot shank. Carried by the ears 52 and 54, and extending transversely therebetween is a cylindrical hinge pin 55. The ears 52 and 54 are provided with blind holes 56 and 58 in axial alignment with the pin 55.

Latching spring 36 is a performed resilient wire spring having spaced apart transversely extending fingers 60 and 62 at one end, and including a cross piece 64 at the other end which is parallel to the fingers 60 and 62. The cross piece 64 of the spring connects with spaced apart side portions 66 and 68 that bend at elbows 70 and 72 respectively where they subtend in the unstressed condition an angle of substantially 90°.

Figure 5:
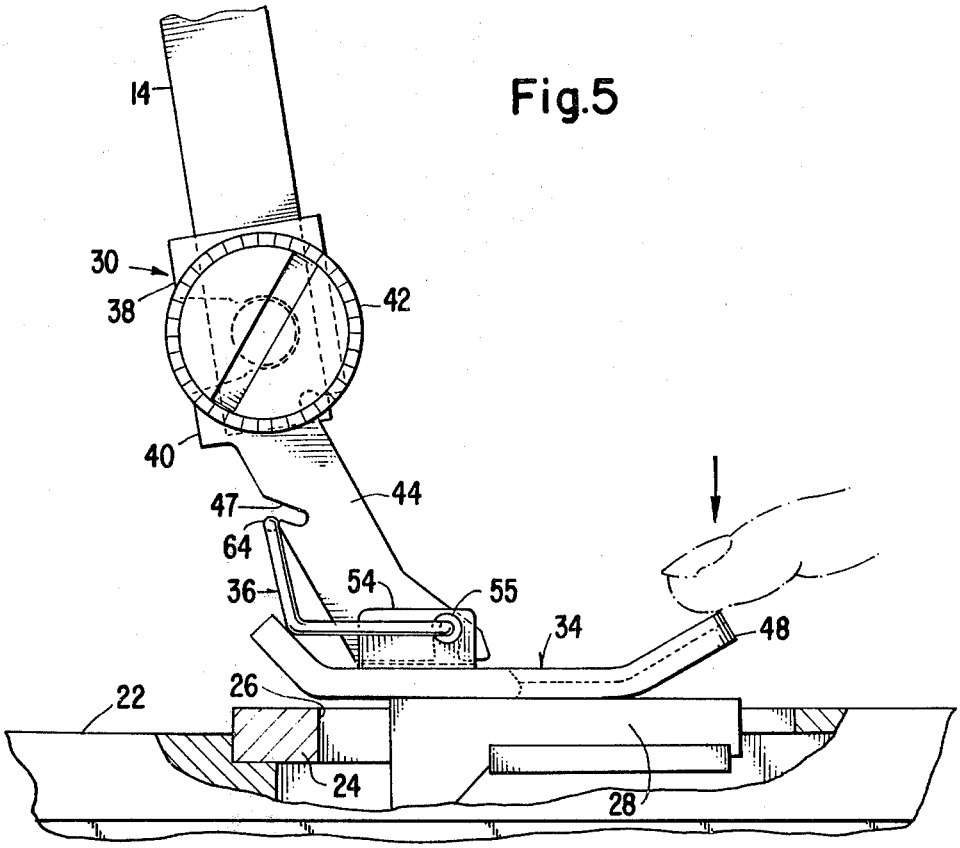
FIG. 5 is an enlarged side elevational view of a sewing machine fragment showing a sole plate being attached to a shank of the presser device of the invention.

The latching spring and sole plate are normally maintained in an assembled relationship by the spring fingers 60 and 62 which extend into the blind holes 56 and 58 in the ears 52 and 54 of the sole plate and thereby pivotally connect the sole plate to the spring. The sole plate and spring are readily attached to the shank 32 by first resting the sole plate on the machine over the feed dog 28 while the presser bar is in a raised position, and then lowering shank 32 onto the presser bar while adjusting the position of the sole plate to align hinge pin 55 with slot 46. The hinge pin 55 is thereby caused to assume a position in the upper end of the slot as shown in FIG. 5, and after the pin has been so positioned, a slight force is applied downwardly at the toe end portion of the sole plate to cause the sole plate to pivot on the feed dog as the presser bar is forced slightly upward against its downward bias. The heel end portion of the sole plate is caused to press against the knees of the spring and cross piece 64 is forced upwardly along the blade 40 of shank 32 until it snaps into notch 47. In the attached position of the sole plate on the shank engagement of the knees of the spring with the bed portion of the sole plate defines a normal substantially horizontal work position for the sole plate.

Figure 6:
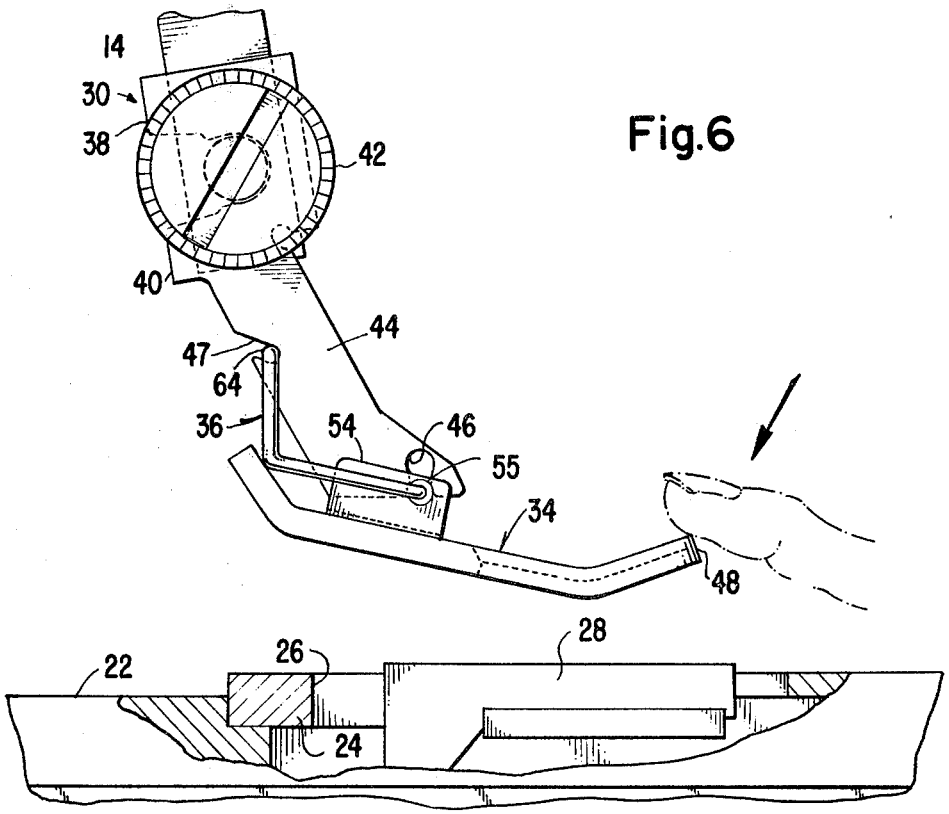
FIG. 6 is an enlarged side elevational view of a sewing machine showing a sole plate being detached from a shank of the presser device of the invention.

The sole plate 34 and attached spring 36 are removed from shank 32 with the application of a downward and rearward force to the toe end of the sole plate as shown in FIG. 6. The heel end portion of the sole plate pivots on the knees of the spring and pin 55 moves out of slot 46 in the bottom of blade 44 as the resilient spring spreads somewhat at the knees. With the continued application of force as indicated to the toe end portion of the sole plate, the cross piece 64 of the spring is caused to move out of the notch whereupon the sole plate and spring may be removed from the shank 32.

It is to be understood that the present disclosure relates to a preferred embodiment of the invention which is for purposes of illustration only, and that various modifications may be made therein without departing from the spirit and scope of the invention as defined in the appended claims.

I claim:

1. A presser device for a sewing machine having a presser bar thereon, said presser device comprising a shank which detachably connects with the presser bar and has both a notch in the rear edge thereof and a slot at the bottom end; a sole plate including a toe end portion, a heel end portion, a work engaging portion therebetween, and a hinge pin mounted on the work engaging portion; a latching spring of resilient wire for attaching the sole plate to said shank, the spring including spaced apart side portions, a cross piece at one end interconnecting the spaced apart side portions, and aligned fingers at the opposite end substantially parallel to the cross piece, the fingers being pivotally connected to the sole plate, said side portions of the spring including a bend which forms knees engageably by the rear end portion of the sole plate for causing the cross piece to be snapped into said notch at the rear edge of the shank while the hinge pin on the sole plate is held up in the slot in the bottom of the shank, and the sole plate to be thereby attached to the shank, the hinge pin being movable out of said slot by pivotal movement of the sole plate on the knees whereupon the cross piece of the spring may be removed from the notch in the shank and the sole plate detached therefrom.

2. The combination of claim 1 wherein the bend in the side portions of the latching spring subtends an angle of substantially ninety degrees in an unstressed condition.

3. The combination of claim 1 wherein the spring fingers and hinge pin are axially aligned.

4. The combination of claim 1 wherein the notch in the shank extends generally downwardly and forwardly therein.

5. The combination of claim 1 wherein engagement of the knees of the spring with the heel portion of the sole plate in the attached position of the sole plate on the shank defines a normal position above the work position for the sole plate.

6. The combination of claim 5 wherein the work engaging portion of the sole plate is substantially horizontal in the said normal position of the sole plate.

* * * * *